US008814759B2

(12) United States Patent
Goldy et al.

(10) Patent No.: US 8,814,759 B2
(45) Date of Patent: Aug. 26, 2014

(54) INTEGRATED PUNCHING BAG SYSTEM

(75) Inventors: Robert Goldy, New York, NY (US); Edwin Chan, Brooklyn, NY (US)

(73) Assignee: Trend Right Research & Development Corporation, New York, NY (US)

( * ) Notice: Subject to any disclaimer, the term of this patent is extended or adjusted under 35 U.S.C. 154(b) by 208 days.

(21) Appl. No.: 13/258,835

(22) PCT Filed: Mar. 25, 2010

(86) PCT No.: PCT/US2010/028609
§ 371 (c)(1),
(2), (4) Date: Oct. 4, 2011

(87) PCT Pub. No.: WO2010/111459
PCT Pub. Date: Sep. 30, 2010

(65) Prior Publication Data

US 2012/0135843 A1 May 31, 2012

Related U.S. Application Data

(60) Provisional application No. 61/163,245, filed on Mar. 25, 2009.

(51) Int. Cl.
*A63B 21/00* (2006.01)

(52) U.S. Cl.
USPC ..... 482/83; 482/90; 482/87

(58) Field of Classification Search
USPC ..... 482/83, 84, 85, 86, 88, 90; 473/440; 248/413
See application file for complete search history.

(56) References Cited

U.S. PATENT DOCUMENTS

| | | | | |
|---|---|---|---|---|
| 1,703,012 | A * | 2/1929 | McNamara | 482/90 |
| 4,486,016 | A | 12/1984 | Rubin | |
| 5,665,035 | A | 9/1997 | Tumminia | |
| 5,730,668 | A | 3/1998 | Hege et al. | |
| 5,792,032 | A * | 8/1998 | Williams et al. | 482/83 |
| 6,027,418 | A | 2/2000 | van Nimwegen et al. | |
| 6,106,443 | A * | 8/2000 | Kuo | 482/83 |
| 7,134,548 | B2 | 11/2006 | Meehan et al. | |
| 7,226,398 | B2 * | 6/2007 | Fu | 482/85 |
| 7,726,398 | B2 * | 6/2010 | Collins et al. | 166/275 |
| 7,798,920 | B1 * | 9/2010 | Cortes | 473/440 |
| 2007/0287608 | A1 | 12/2007 | Hallar | |

OTHER PUBLICATIONS

Chinese Office Action dated Apr. 28, 2013, relating to Chinese Patent Application No. 201080013206.8.
Chinese Office Action dated Dec. 10, 2013, relating to Chinese Patent Application No. 201080013206.8.

* cited by examiner

*Primary Examiner* — Jerome W Donnelly
(74) *Attorney, Agent, or Firm* — Dinsmore & Shohl LLP

(57) ABSTRACT

A punching bag base and punching bag assembly. The base provides multiple areas to store exercise accessories such as weighted dumbbells and weighted ankle weights. In one form, the areas formed in the base to receive weights or related exercise equipment form a shape that is complementary to that of the equipment stored in it. In another form, the base can be of a generally hollow construction to accept ballast to provide additional stability of the base when it is placed on a floor or related support structure. The system may also include an integrated hook placed on the pole that allows the user the ability to hang boxing gloves, towels or other exercise equipment. The system may also include a wheel assembly to facilitate ease of movement.

6 Claims, 3 Drawing Sheets

INTEGRATED PUNCHING BAG SYSTEM

CROSS-REFERENCE TO RELATED APPLICATIONS

This application is a U.S. national phase entry of International Application No. PCT/US2010/028609, filed Mar. 25, 2010, which claims the benefit of U.S. Provisional Application Ser. No. 61/163,245, filed Mar. 25, 2009.

The present invention generally relates to a punching bag system or assembly that includes a device that creates a stable base for a portable punching bag, and more particularly to an assembly and device that has integrated compartments on the base for storage of accessories such as hand dumbbells or jump ropes, as well as personal effects.

Products exist for providing a stable base for a punching bag; however, none of them incorporate storage or related additional features to the base. Moreover, punching bag assemblies with a bag and a base are often large, cumbersome configurations that are incompatible with movement, storage and related portability attributes. The lack of these features limits the effectiveness of such a system. For example, a base that is massive enough to remain immobile during bag use is also likely to be difficult to move for storage or other relocation. Likewise, failing to provide storage space for related or ancillary exercise equipment means that a user must leave such equipment strewn around the exercise area, where the risk of losing or having such equipment get in the way is greater. As such, their effectiveness is limited. What is needed is an integrated punching bag base that can overcome these problems and disadvantages.

This need is met by the present invention, where one or more of storage, mobility and related features are incorporated into the base. In one form, compartments are formed in the punching bag base to enhance its functionality. In accordance with one embodiment of the present invention, a punching bag base includes a lower surface configured to engage a generally planar support structure, an upper surface with numerous receptacles (also referred to as compartments) formed therein and mounting structure to allow connection of the base to a punching bag. As such, the upper and lower parts of the base together form a housing such that the receptacles can be built into in order to accept a connection for a punching bag support pole or act as a placeholder for weights or related exercise equipment or personal effects. The support structure onto which the base can rest is preferably a floor or a related generally planar surface.

Optionally, the base is made from plastic such that it defines a one-piece (i.e., unitary) structure Likewise, it can be formed such that it defines a substantially hollow construction. One or more ballast access ports can be formed in the upper surface to enable selective introduction or removal of sand, liquid, concrete or related fluid ballast material. Such selective access can be implemented by a threaded cap, snap-on cap, pivotably-mounted cap or the like. Likewise, ballast may be placed in the hollow base or in one or more of the shaped compartments that are formed in the base. In one form, the ballast may be sand that can be disposed within the base. Such sand (or related granular material) can be introduced into or removed from the base through the access port.

The punching bag base may also include one or more wheels formed on or otherwise coupled to it to facilitate its selective rolling movement. In addition, a handle may be formed in or otherwise connected to the base. In one particular form, the handle is disposed on a substantially opposing portion of the base from the one or more wheels to (in conjunction with the wheel or wheels) further promote ease of base movement. One or more of the receptacles can be shaped in the form of exercise equipment in the base upper surface or peripheral edge. A preferable shape is that of a conventional dumbbell, such as in a five, ten, twenty-five or other commonly-used sizes. In another form, dumbbells and related weight-training equipment that are sized to fit with one or more of the base compartments may help form at least part of the aforementioned ballast. An enhanced grip mechanism, such as a high-coefficient of friction material, may also be placed on the lower surface of the base such that when the base is situated on a floor or other mounting structure, the enhanced grip mechanism helps to resist relative sliding movement between the two.

According to another aspect of the present invention, a punching bag assembly includes a punching bag, a mounting pole with a first end and a second end such that one of the ends is connectable to the bag, and a base connected to the other end of the mounting pole. The base defines a lower surface configured to engage a floor or other generally planar support structure, and an upper surface with at least one exercise equipment receptacle formed therein. Although the form shown in the figures depicts a certain number of integrated storage compartments, it will be appreciated by those skilled in the art that more or fewer can be created, depending on the configuration and need. The pole may include adjustment features to allow it to be raised and lowered as needed. An integrated hook may also be placed on an upper portion of the pole to allow the user to hang or store their punching gloves.

According to another aspect of the invention, a portable punching bag assembly includes a punching bag, a base, means for connecting the bag to the base and means for facilitating movement of the assembly. The base includes a lower surface that engages a generally planar support structure (such as a floor). An upper surface of the base has numerous compartments formed in it, where at least one of the compartments is in the shape of a dumbbell or related exercise weight.

Optionally, the connecting means includes a pole that can be used to secure the base and the bag such that the two are pivotably mounted to one another. The movement means may include one or both of a handle and a wheel. The handle can be formed in the base, where it will be understood that such forming into can also include being securely mounted thereto (such as by rivets, screws, adhesives or related fastening means). Likewise, the wheel may include more than one wheel. In another option, the base may define a generally hollow construction, such as by a molded plastic material or the like. Ballast (such as sand or any of the other aforementioned flowable materials) may be included in a hollow portion of the base. In addition to the shaped receptacles, the numerous compartments formed in the base may include one or more additional storage compartments.

The following detailed description of the preferred embodiments of the present invention can be best understood when read in conjunction with the following drawings, where like structure is indicated with like reference numerals and in which.

Figure 1:
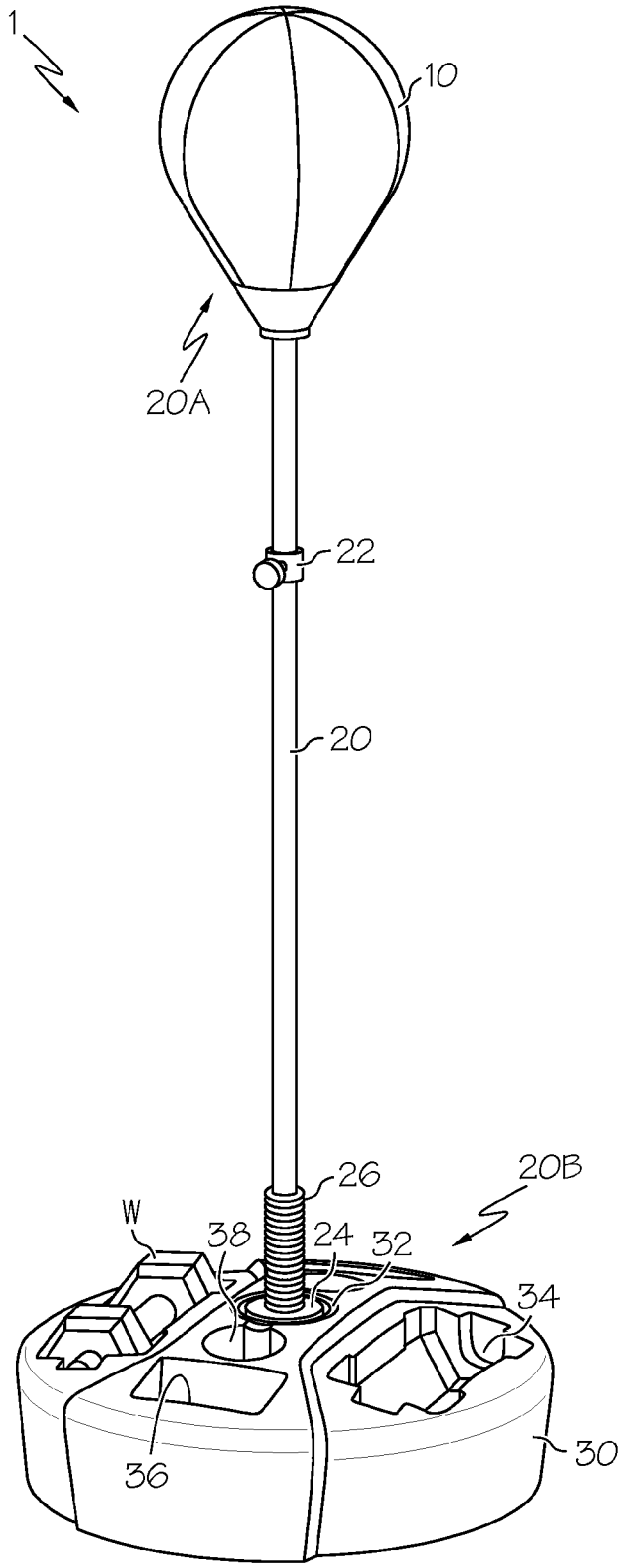
FIG. 1 shows an embodiment of the integrated punching bag base of the present invention with a punching bag attached.

Referring first to FIG. 1, a punching bag assembly 1 includes a punching bag 10 mounted onto the top 20A of a pole 20 or mast that in turn is secured at its bottom 20B to base 30. The pole 20 may include a height adjustment device 22 to facilitate the raising and lowering of the punching bag 10 as needed. One or more hooks (not shown) may be mounted to the pole to allow the user additional storage for gloves, towels and other exercise equipment. The connection (not shown) between the top 20A part of the pole 20 and the punching bag 10 may be through any conventional means, such as a threaded or screwed relationship or an adhesive, weld, clip or other permanent fastener, while the bottom 20B part of the pole 20 can be secured to base 30 through a mechanism 24 situated in an axially-oriented mounting aperture 32. In one form, the mechanism 24 forms a secure connection between the base 30 and the pole 20 so that the punching bag 10 is cantilevered. As such, when a user strikes the punching bag 10, the punching bag 10 and top 20A part of the pole 20 becomes dislocated relative to their at-rest position, while the lower 20B part of the pole 20 remains affixed to the base 30, thereby allowing a pivoting motion between the punching bag 10 and the base 30. The mechanism 24 may include a spring 26, which gives the pole 20 an added measure of cantilever flexibility. The pivoting motion between the pole 20 and the base 30 can be further enhanced by providing a rotational coupling (such as a bearing sleeve, not shown) between the bottom 20B part of the pole 20 and the corresponding mechanism 24 of the base 30. With such construction, an additional degree of freedom of movement of the pole 20 can be provided.

Figure 2:
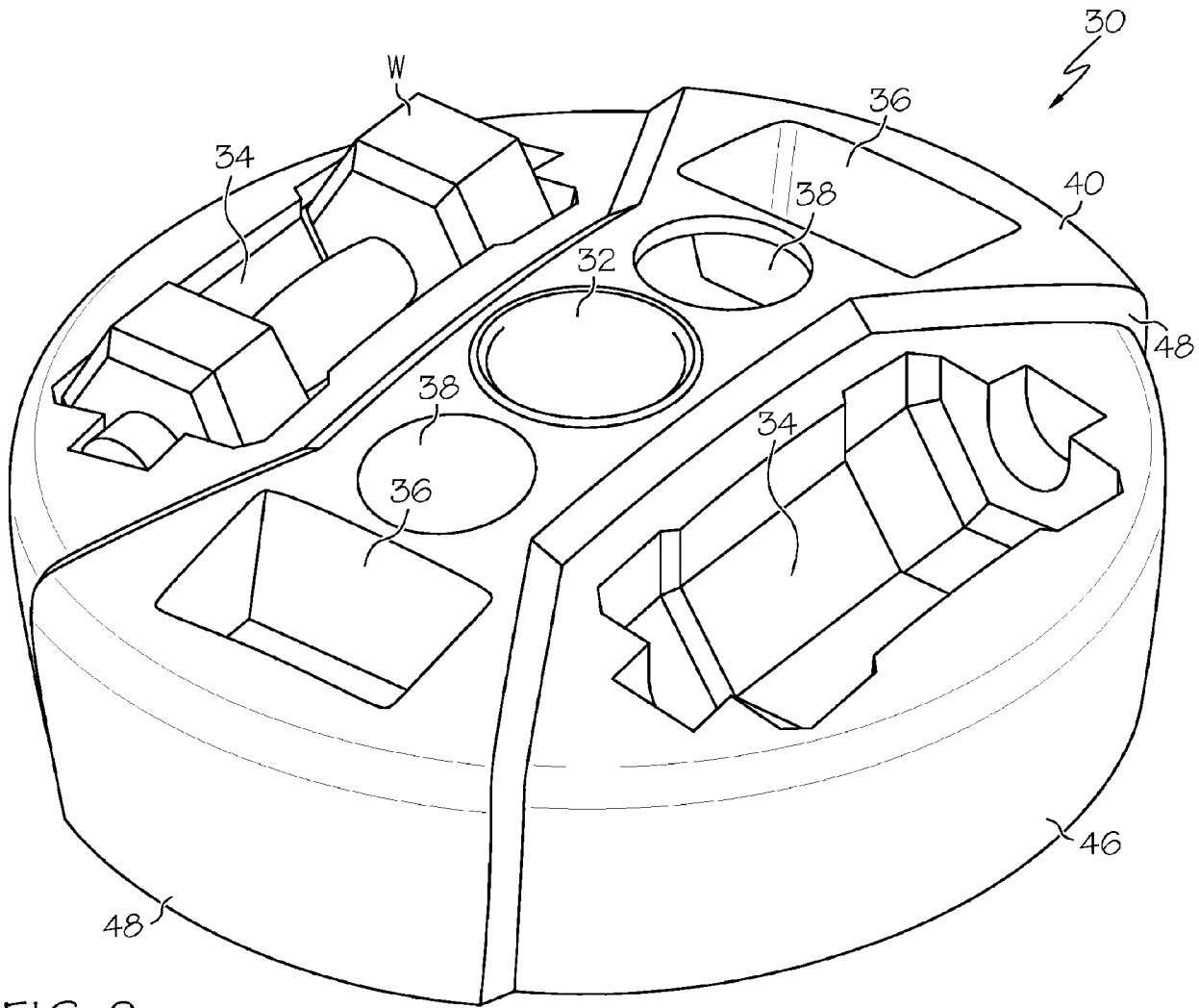
FIG. 2 shows a perspective view of the top of the base of FIG. 1 without the punching bag.

Referring with particularity to FIG. 2, details of the additional features that are accommodated in base 30 are shown. In one form, storage receptacles (or compartments) 34 are formed into base 30 and can be specifically shaped for hand weights (also called dumbbells or exercise weights) W. In the present context, a shaped receptacle or compartment is one that defines a particular pattern or configuration that is dictated by the particular nature of the article to be placed therein, rather than by more generalized concerns. This, while a purely rectangular or cylindrical compartment defines a shape in the conventional sense, because such configuration isn't formed for a particular article, it is not considered "shaped" in the manner that the dumbbell storage receptacles 34 are.

In a particular configuration, the base 30 can be formed from a single piece of moldable material, such as a plastic or related resin. A preferred placement for shaped storage receptacles 34 and other storage receptacles or compartments 36 and 38 is in the upper (or top) surface 40 of the base 30 as it allows easy access for the user. In addition, hand weights 100, ankle weights or the like, by virtue of their relatively dense, heavy construction, may provide more stability to the base 30 when placed therein. The other storage compartments 36 and 38 can be used to temporarily house ankle weights, jump ropes and other exercise accessories (none of which are shown), as well as small items, such as keys or key chains, wallets and related personal effects.

As shown, the base 30 defines a generally circular construction with peripheral surface 46, although it will be appreciated by those skilled in the art that other shapes, such as square, rectangular, circular or oval shapes could also be employed, and that such additional shapes are within the scope of the present invention. As presently shown, peripheral surface 46, while extending in a generally horizontal and radially outward direction, is considered to form (or at least be cooperative with) a portion of the upper surface 40 insofar as any recesses (not shown) formed in the peripheral surface 46, such as those used as the receptacles and compartments 34, 36 and 38 discussed above to hold a dumbbell or related piece of exercise equipment, could be readily accessed by a user in a manner generally similar to that of the receptacles or compartments formed in the upper surface 40 of the base 30. Small protruding areas 48 can extend from substantially opposed parts of the peripheral surface 46, and can be used to accommodate one or more of a wheel (as will be discussed below), handle (not shown) or other accoutrements. In another form, an access port and removable lid (neither of which are shown) can be used to allow the introduction of sand, water or other flowable ballast material into the substantially hollow compartment or housing formed in base 30.

Figure 3:
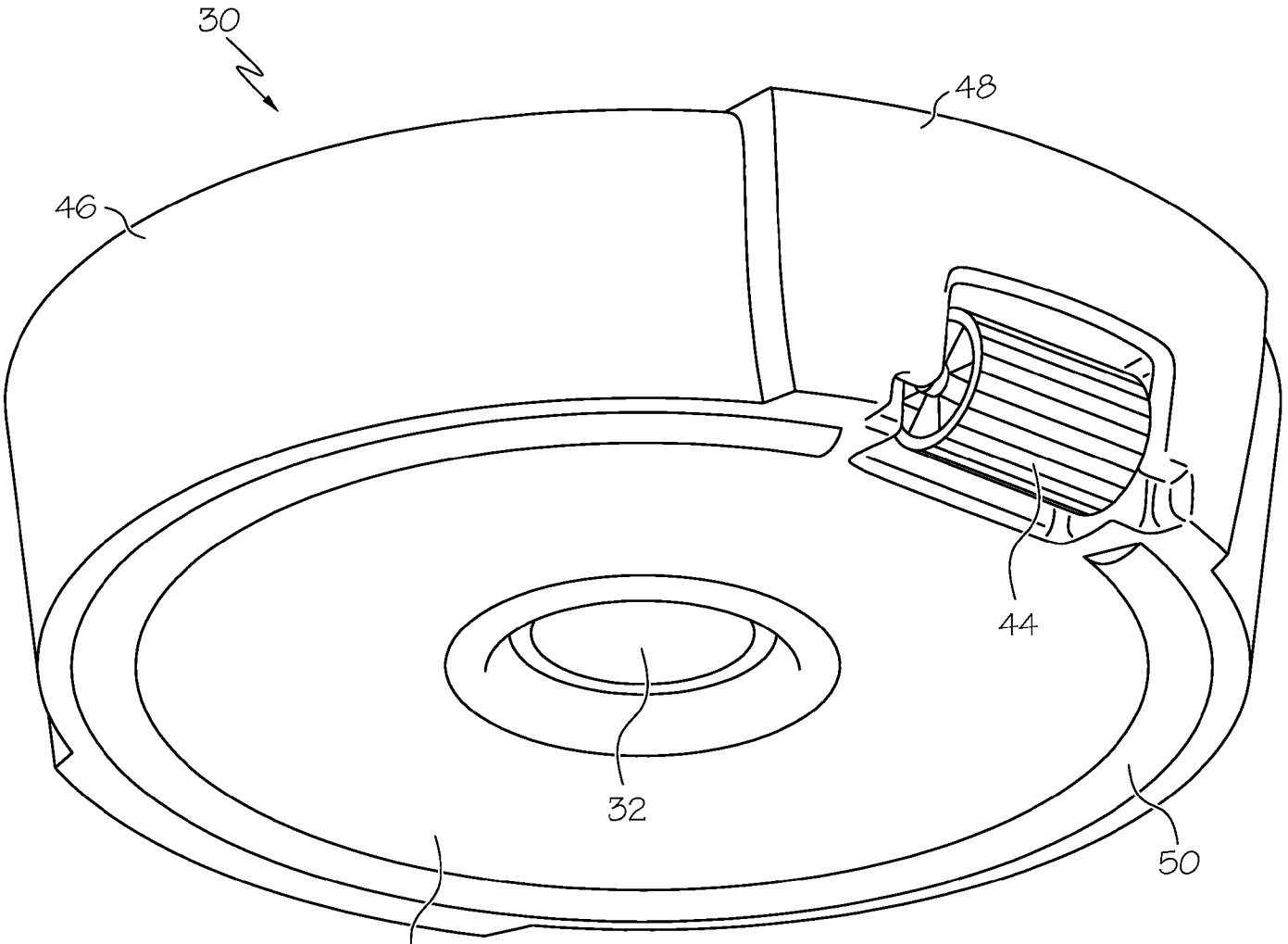
FIG. 3 shows a perspective view of the bottom of the base of FIG. 2.

Referring next to FIG. 3, a lower perspective view of base 30 shows a bottom (or lower) surface 42 through which the mounting aperture 32 is formed. At least one wheel 44 is integrated into the base 30 to make it easier for a user to tilt the base 30 and roll it for repositioning, storage or the like. As shown, the wheel 44 can be formed in the protruding area 48 or the peripheral surface 46 of the base 30. The bottom surface 42 of base 30 forms a generally planar structure to allow steady, secure placement of the base 30 onto a floor or related mounting structure. A generally circumferential ring 50 formed on the bottom surface 42 can be used to enhance the secure connection of the base 30 to the floor. In one particular form, the ring 50 can be made from a spongy, tacky or otherwise enhanced grip construction to increase the coefficient of friction between the bottom surface 42 and floor. Such a ring 50 may further define a generally downward-facing semi-cylindrical shape, and may on its upward-facing side include an adhesive or other fastening means to connect it to the bottom surface 42 of base 30. The axially-extending mounting aperture 32 is formed through the base 30 and may allow for an appropriate connection means to allow a secure coupling between the lower 20B part of the pole 20 and the base 30.

The foregoing detailed description and preferred embodiments therein are being given by way of illustration and example only; additional variations in form or detail will readily suggest themselves to those skilled in the art without departing from the spirit of the invention. Accordingly, the scope of the invention should be understood to be limited only by the appended claims.

The invention claimed is:

1. A punching bag assembly comprising:

a punching bag;

a mounting pole comprising a first end and a second end such that one of said ends is connectable to said bag; and a base connected to said mounting pole, said base defining a lower surface configured to engage a generally planar support structure, and an upper surface with a plurality of exercise equipment receptacle and at least one additional storage compartment formed therein.

2. A portable punching bag assembly comprising:

a punching bag;

a base comprising a lower surface configured to engage a generally planar support structure, an upper surface defining a plurality of compartments formed therein, said plurality of compartments comprising a plurality of shaped receptacle configured to accept a complementary-shaped exercise weight therein and at least one additional storage compartment;

means for facilitating movement of said assembly; and means for connecting said bag to said base.

3. The assembly of claim 1, wherein said connecting means comprises a pole defining a secure connection between a lower portion thereof and said base such that said bag is pivotably mounted to said base.

4. The assembly of claim 1, wherein said movement means comprises at least one of a handle formed in said base and a wheel cooperative with said base.

5. The assembly of claim 2, wherein said base defines a generally hollow construction.

6. The assembly of claim 5, further comprising ballast disposed in a hollow portion of said generally hollow construction of said base.

* * * * *